US010602779B2

(12) United States Patent
Chen

(10) Patent No.: US 10,602,779 B2
(45) Date of Patent: Mar. 31, 2020

(54) ELECTRONIC CIGARETTE

(71) Applicant: SHENZHEN IVPS TECHNOLOGY CO., LTD., Shenzhen, Guangdong Province (CN)

(72) Inventor: Wen Chen, Shenzhen (CN)

(73) Assignee: Shenzhen IVPS Technology Co. Ltd. (CN)

( * ) Notice: Subject to any disclaimer, the term of this patent is extended or adjusted under 35 U.S.C. 154(b) by 103 days.

(21) Appl. No.: 15/849,580

(22) Filed: Dec. 20, 2017

(65) Prior Publication Data

US 2018/0368476 A1 Dec. 27, 2018

(30) Foreign Application Priority Data

Dec. 20, 2016 (CN) ..... 2016 2 1402789 U

(51) Int. Cl.
*A24F 47/00* (2020.01)
*H01R 13/631* (2006.01)
*H01R 13/627* (2006.01)

(52) U.S. Cl.
CPC ..... *A24F 47/008* (2013.01); *H01R 13/6276* (2013.01); *H01R 13/631* (2013.01)

(58) Field of Classification Search
CPC ..... A24F 47/008
See application file for complete search history.

(56) References Cited

U.S. PATENT DOCUMENTS 9,089,168 B2 * 7/2015 Liu ..... A61M 11/042
9,913,494 B2 * 3/2018 Liu ..... A24F 47/008
9,943,113 B2 * 4/2018 Liu ..... A24F 47/008
10,069,240 B2 * 9/2018 Liu ..... A24F 47/008
10,117,461 B2 * 11/2018 Chen ..... A24F 47/008
2013/0340779 A1 * 12/2013 Liu ..... A24F 47/002 131/329
2015/0083144 A1 * 3/2015 Xiang ..... A24F 47/008 131/328
2015/0296889 A1 * 10/2015 Liu ..... A24F 47/008 131/329
2017/0035109 A1 * 2/2017 Liu ..... H05B 3/24
2017/0325504 A1 * 11/2017 Liu ..... A24F 47/00
2018/0020723 A1 * 1/2018 Davis ..... A61M 11/042 392/404
2018/0166238 A1 * 6/2018 Chen ..... A24F 47/00
2018/0368476 A1 * 12/2018 Chen ..... A24F 47/008
2019/0307174 A1 * 10/2019 Qiu ..... A24F 47/008
2019/0328045 A1 * 10/2019 Qiu ..... H01R 13/631

FOREIGN PATENT DOCUMENTS

CN 204 317 494 U 5/2015
EP 3338570 A 7/2017
KR 2016 0000718 U 3/2016
WO 2015/161406 A1 10/2015
WO 2016/197658 A1 12/2016

* cited by examiner

*Primary Examiner* — James Harvey
(74) *Attorney, Agent, or Firm* — IP-PAL Patent US

(57) ABSTRACT

The present disclosure relates to an electronic cigarette. The electronic cigarette includes a shell with a suction end, a battery box, an atomizer assembly connected to the battery box, and a guiding component configured for guiding the atomizer assembly. The atomizer assembly slides relative to the battery box via the guiding component to achieve a fixed connection with the battery box.

7 Claims, 3 Drawing Sheets

ELECTRONIC CIGARETTE

CROSS REFERENCE TO RELATED APPLICATIONS

The present application claims priority to Chinese Patent Application CN 201621402789.4 filed on Dec. 20, 2016.

TECHNICAL FIELD

The present disclosure relates to electronic cigarettes.

BACKGROUND

Nowadays, in a one-piece electronic cigarette, an atomizer is usually fixed by a snap-fit connection plus a magnet or a threaded connection. In the snap-fit connection plus the magnet, one end of the atomizer is usually fixed by a snap-fit connection, and the other end is fixed using the magnet. However, the snap-fit connection may be easily damaged, and a large magnetic force is required to fix the atomizer, thus rending instability of the installation of the atomizer. In the threaded connection, it is inconvenient to assemble the atomizer, and such a connection limits a shape of the atomizer to be circular, thus limiting a design of the electronic cigarette.

To overcome the above shortcoming, it is necessary to provide a new electronic cigarette.

SUMMARY

The present disclosure relates to an electronic cigarette. The electronic cigarette includes a shell with a suction end, a battery box, an atomizer assembly connected to the battery box, and a guiding component configured for guiding the atomizer assembly. The atomizer assembly slides relative to the battery box via the guiding component to achieve a fixed connection with the battery box.

Preferably, the atomizer assembly is fixedly connected with the battery box via a magnetic attraction connection or a snap-fit connection.

Preferably, the atomizer assembly comprises a housing and an atomizer arranged in the housing, the guiding component comprises a lead rail and a sliding groove, the lead rail is arranged on a top part of a sidewall of the battery box, the sliding groove is defined in an end of the housing, and the sliding groove matches with the lead rail.

Preferably, the guiding component comprises two lead rails, and the two lead rails are arranged on the top part of the two opposite sidewalls of the battery box.

Preferably, the two lead rails extend downwards obliquely along a slide-in direction of the atomizer assembly.

Preferably, the fixing structure further includes a positive electrode and a negative electrode arranged between the two lead rails, wherein the positive electrode and the negative electrode are in elastic contact with the atomizer, a channel is provided in an end of the atomizer adjacent to the sliding groove, the channel extends along a sliding direction of the atomizer assembly, and the positive electrode and the negative electrode are arranged in the channel.

Preferably, a recess is defined between the two lead rails, a protrusion is provided on an end of the atomizer adjacent to the sliding groove, and the protrusion matches with the recess.

Preferably, a direction that the recess extends is parallel to a sliding direction of the atomizer assembly.

Preferably, the atomizer comprises a transverse bar formed on a sidewall thereof, the housing defines a gap in a sidewall thereof, the gap matches with the transverse bar, and the gap is configured for restricting a position of the atomizer.

In the present disclosure, the atomizer assembly slides to couple with the battery box via the guiding component, then the atomizer assembly is fixedly with the battery box. In the present fixing structure, the atomizer assembly first slides to connect with the battery box, and then slides to an installing position where the atomizer assembly is fixedly connected with the battery box. The installation is simple, and it is convenient to disassemble. The atomizer assembly and the battery box are connected twice, thus the stability of the structure is good.

BRIEF DESCRIPTION OF THE DRAWINGS

For a better understanding of the embodiments of the present disclosure or the technical scheme in the prior art, accompanying drawings needed in the description of the embodiments or the prior art are simply illustrated below. Obviously, the accompanying drawings described below are some embodiments of the present disclosure. For the ordinary skill in the field, other accompanying drawings may be obtained according to the structure shown in these accompanying drawings without creative work.

Figure 1:
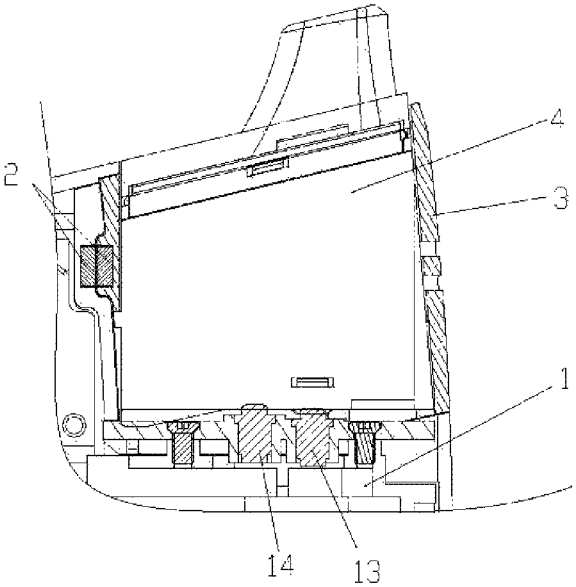
FIG. 1 is a cross-sectional view of a fixing structure for an atomizer according to one embodiment.

The implementation of aims, the function features and the advantages of the present disclosure are described below in further detail in conjunction with embodiments with reference to the drawings.

DETAILED DESCRIPTION

A clear and complete description as below is provided for the technical scheme in the embodiments of the present disclosure in conjunction with the drawings in the embodiments of the present disclosure. Obviously, the embodiments described hereinafter are simply part embodiments of the present disclosure, but all the embodiments. All other embodiments obtained by the ordinary skill in the art based on the embodiments in the present disclosure without creative work are intended to be included in the scope of protection of the present disclosure.

It should be noted that all directional indications (such as top, bottom, left, right, front, behind . . . ) in the embodiments of the present disclosure are merely to illustrate a relative position relation, a relative motion condition, etc. between each part in a certain state (for example, the state shown in the drawings). If the state changes, the directional indication changes accordingly.

In addition, if terms "first", "second", etc. appear in the present disclosure, they are merely for the purpose of description, but cannot be understood as the indication or implication of relative importance or as the implicit indication of the number of the designated technical features; therefore, features defined by "first" and "second" may specifically or implicitly include one or more such features.

In the description of the present disclosure, unless otherwise stated, "a plurality of" means at least two, for example, two, three, etc.

In the present disclosure, unless otherwise specifically stated and defined, terms "connected", "fixed", etc. should be interpreted expansively. For example, "fixed" may be fixed connection, also may be detachable connection, or integration; may be mechanical connection, also may be electrical connection; may be direct connection, also may be indirect connection through an intermediate, and may be internal communication between two elements or interaction of two elements, unless otherwise specifically defined. The ordinary skill in this field can understand the specific implication of the above terms in the present disclosure according to specific conditions.

In addition, technical schemes of each embodiment of the present disclosure may be combined mutually; however, this must be carried out on the basis that the ordinary skill in this field can implement the combination. When the combination of technical schemes has a conflict or cannot be implemented, it should considered that such combination of technical schemes does not exist and is not in the scope of protection claimed by the present disclosure.

The present disclosure relates to an electronic cigarette, aiming to solve the problem of weak stability in structure and uneasy disassembly in related art.

Figure 2:
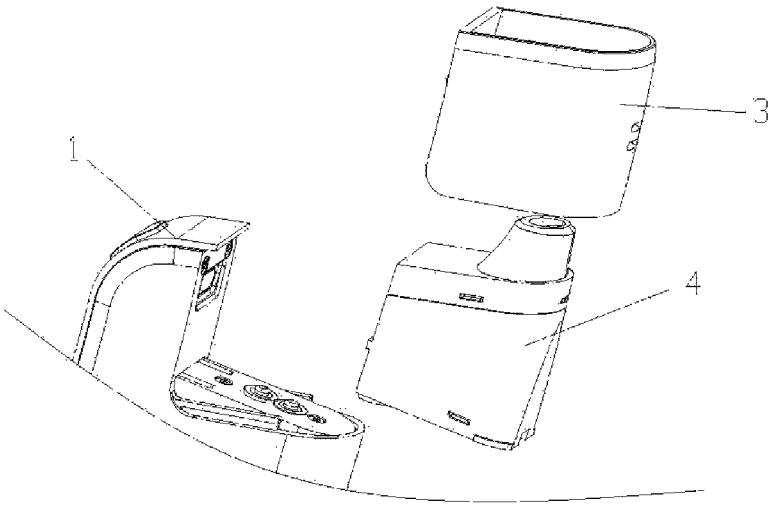
FIG. 2 is an exploded perspective view of the fixing structure.

Referring to FIGS. 1-2, in one embodiment, a fixing structure for an atomizer includes a battery box 1, an atomizer assembly (not labeled) connected with the battery box 1, and a guiding component (not labeled) configured for guiding the atomizer assembly. The atomizer assembly slides to achieve a fixed connection with the battery box 1 via the guiding component. In the fixing structure, the atomizer assembly slides to connect with the battery box 1 via the guiding component, and then the atomizer assembly slides to an installing position where the atomizer assembly is fixedly connected with the battery box. It is easy to assemble and convenient to detach. The atomizer assembly is connected to the battery box twice, and thus, the stability of the structure is good.

In a preferred embodiment, referring to FIG. 1, the atomizer assembly is fixedly connected with the battery box 1 via a magnet 2 or a snap-fit structure. When using the magnet 2, each of the atomizer assembly and the battery box 1 includes the magnet 2. The atomizer assembly slides to connect with the battery box 1 via the guiding component, then the atomizer assembly slides to the installing position where the atomizer assembly is fixedly connected with the battery box 1 via an attraction force of the magnet 2. The installation is very simple. When using the snap-fit connection, one of the atomizer assembly and the battery box 1 includes a latching element (not shown), the other of the atomizer assembly and the battery box 1 includes a positioning element (not shown). The atomizer assembly and the battery box 1 are fixedly coupled by engagement of the latching element and the positioning piece. In addition, a slide-in direction is a direction along which the atomizer assembly is assembled to the battery box 1, and a slide-out direction is a direction along which the atomizer assembly is detached from the battery box 1. A sliding direction of the atomize assembly includes the slide-in direction and a slide-out direction.

Figure 3:
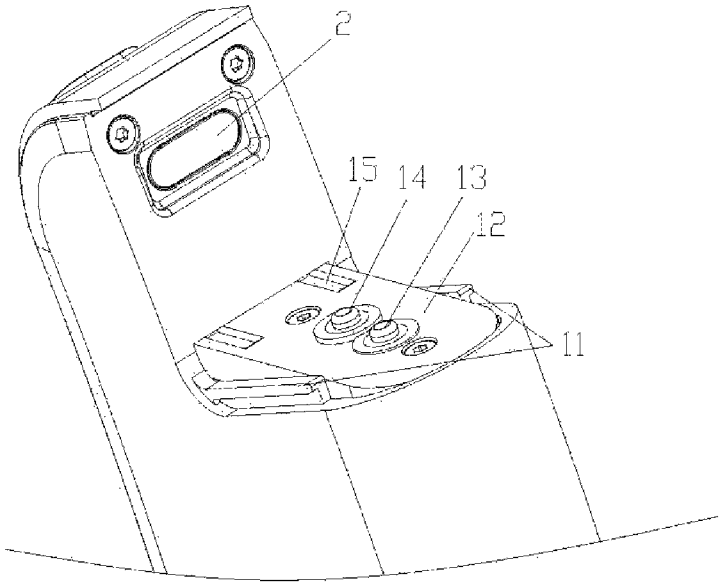
FIG. 3 is a perspective view of a battery box.
Figure 4:
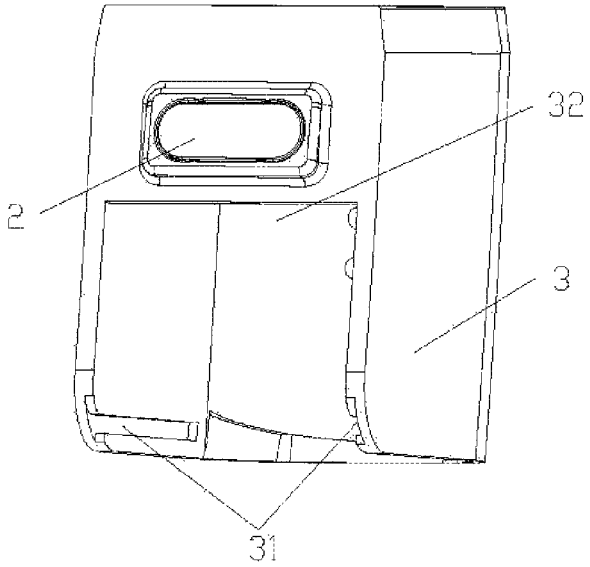
FIG. 4 is a structural view of a housing.
Figure 5:
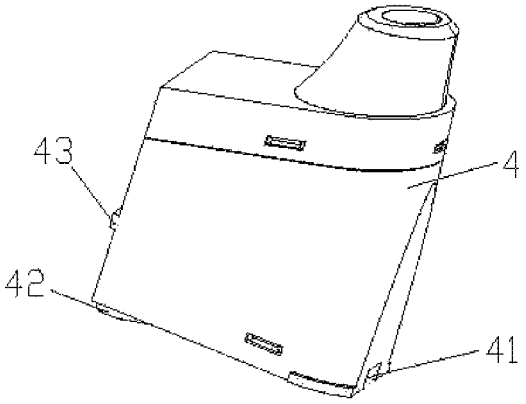
FIG. 5 is a perspective view of an atomizer.

In addition, referring to FIGS. 2-4, for easy sliding connection between the atomizer assembly and the battery box 1, the atomizer assembly includes a housing 3 and an atomizer 4 arranged in the housing 3, and the guiding component includes a lead rail 11 and a sliding groove 31 matching with the lead rail 11. The lead rail 11 is arranged on a top part of a sidewall of the battery box 1, and the sliding groove 31 is defined in an end of the housing 3. Referring to FIG. 3, quite usefully, the lead rail 11 has a right angle. Because the sliding groove 31 is coupled with the lead rail 11, the housing 3 can only moves along the sliding direction of the atomizer assembly, and accordingly, the stability of the structure is good. The atomizer 31 includes a mouthpiece (not labeled) at an end, and defines a channel 41 at the other end. The atomizer 4 is assembled into the housing 3 via an end of the housing 3 with the sliding groove 31, and the mouthpiece exposes from the other end of the housing 3. The atomizer 4 includes a transverse bar 43 formed on a sidewall. The housing 3 defines a gap 32 in a sidewall. The gap 32 is configured for positioning the atomizer 4, and matches with the transverse bar 43. After the atomizer 4 is assembled into the housing 3, the transverse bar 43 is coupled with the gap 32, thus limiting a position of the atomizer 4 within the housing 3. In the atomizer assembly, the installation and the disassembly of the atomizer 4 and the housing 3 is quite simple. After the atomizer 4 is damaged, the user detaches the atomizer 4 from the housing 3, and replaces the atomizer 4 with a new one.

Referring to FIG. 3, to make the sliding connection more convenient between the atomizer assembly and the battery box 1, and make the connection more stable, two lead rails 11 are provided. The two lead rails 11 are arranged on a top part of two opposite sidewalls of the battery box 1.

Further, the two lead rails 11 extend downwards obliquely along a slide-in direction of the atomizer assembly. Since the two lead rails 11 extend downwards obliquely along a slide-in direction of the atomizer assembly, the configuration can help to save effort when the user installs the atomizer assembly along the lead rails downwards.

In addition, a positive electrode 13 and a negative electrode 14 are provided between the two lead rails 11. The positive electrode 13 and the negative electrode 14 are in elastic contact with the atomizer 4. The channel 41 is defined in an end of the atomizer 4 adjacent to the sliding groove 31, and extends along a sliding direction of the atomizer assembly. The positive electrode 13 and the negative electrode 14 are in positioned in the channel 41. Each of the positive electrode 13 and the negative electrode 14 includes a spring inside, and thus is retractable. Quite usefully, an inclined surface (not shown) is provided in the channel 41, and extends upwards along a slide-in direction of the atomizer assembly. When the atomizer assembly slides to couple with the battery box 1, the positive electrode 13 and the negative electrode 14 are pressed down by the inclined surface. After the atomizer assembly is fixedly connected with the battery box 1, the positive electrode 13 and the negative electrode 14 contact with a conductive part in the channel 41, thus powering the atomizer 4. Accordingly, a heating element in the atomizer 4 is powered to heat, thus making tobacco liquid to vaporize and forming aerosol. Thus, effect of simulating of smoking is achieved. The positive electrode 13 and the negative electrode 14 provide the atomizer 4 an elastic force along an installing direction of the atomizer 4, thus fixing the atomizer 4 in the housing 3.

A recess 15 is defined between the two lead rails 11, and a protrusion 42 is provided on an end of the atomizer 4 adjacent to the sliding groove 31. The protrusion 42 matches with the recess 15. After the atomizer assembly slides to couple with the battery box 1, the protrusion 42 is engaged in the recess 15, thus limiting a position of the atomizer assembly, and making the whole structure more stable. An extending direction of the recess 15 is parallel to a sliding direction of the atomizer assembly. After the protrusion 42 is engaged in the recess 15, the protrusion 42 is capable of sliding along a sliding direction of the atomizer assembly. Accordingly, it is more convenient to assemble the atomizer assembly.

The present disclosure also provides an electronic cigarette. The electronic cigarette includes a shell with a suction end and the above-described fixing structure arranged in the shell. The electronic cigarette includes the above fixing structure. Accordingly, the installation of the electronic cigarette is simple, convenient to disassemble, and stable in structure.

The above are preferred embodiments of the present disclosure merely and are not intended to limit the patent scope of the present disclosure. Any equivalent structures made according to the description and the accompanying drawings of the present disclosure without departing from the idea of the present disclosure, or any equivalent structures applied in other relevant technical fields directly or indirectly are intended to be included in the patent protection scope of the present disclosure.

What is claimed is:

1. An electronic cigarette, comprising:

a battery box;

an atomizer assembly connected to the battery box; and a guiding component configured for guiding the atomizer assembly, wherein the atomizer assembly slides relative to the battery box via the guiding component to achieve a fixed connection with the battery box, wherein the atomizer assembly comprises a housing and an atomizer arranged in the housing, the guiding component comprises a lead rail and a sliding groove, the lead rail is arranged on a top part of a sidewall of the battery box, the sliding groove is defined in an end of the housing, and the sliding groove matches with the lead rail;

wherein the atomizer comprises a transverse bar formed on a sidewall thereof, the housing defines a gap in a sidewall thereof, the gap matches with the transverse bar, and the gap is configured for restricting a position of the atomizer.

2. The electronic cigarette according to claim 1, wherein the atomizer assembly is fixedly connected with the battery box via a magnetic attraction connection or a snap-fit connection.

3. The electronic cigarette according to claim 1, wherein the guiding component comprises two lead rails, and the two lead rails are arranged on the top part of the two opposite sidewalls of the battery box.

4. The electronic cigarette according to claim 3, wherein a recess is defined between the two lead rails, a protrusion is provided on an end of the atomizer adjacent to the sliding groove, and the protrusion matches with the recess.

5. The electronic cigarette according to claim 3, wherein the two lead rails extend downwards obliquely along a slide-in direction of the atomizer assembly.

6. The electronic cigarette according to claim 3, further comprising a positive electrode and a negative electrode arranged between the two lead rails, wherein the positive electrode and the negative electrode are in elastic contact with the atomizer, a channel is provided in an end of the atomizer adjacent to the sliding groove, the channel extends along a sliding direction of the atomizer assembly, and the positive electrode and the negative electrode are arranged in the channel.

7. The electronic cigarette according to claim 4, wherein a direction that the recess extends is parallel to a sliding direction of the atomizer assembly.

* * * * *